US007868209B2

(12) United States Patent
Duchesne et al.

(10) Patent No.: US 7,868,209 B2
(45) **Date of Patent: *Jan. 11, 2011**

(54) PROCESS FOR MAKING BORATED ALKALINE EARTH METAL TOLUENE SULFONATES

(75) Inventors: Perla Duchesne, Notre Dame de Gravenchon (FR); John McDonald, Emeryville, CA (US); Gilles Sinquin, Saint Martin du Manoir (FR); Pierre Tequi, Breaute (FR)

(73) Assignees: Chevron Oronite SA, Cedex (FR); Chevron Oronite Company LLC, San Ramon, CA (US)

( * ) Notice: Subject to any disclaimer, the term of this patent is extended or adjusted under 35 U.S.C. 154(b) by 495 days.

This patent is subject to a terminal disclaimer.

(21) Appl. No.: 11/755,206

(22) Filed: May 30, 2007

(65) Prior Publication Data

US 2008/0300426 A1 Dec. 4, 2008

(51) Int. Cl.
*C07F 5/02* (2006.01)

(52) U.S. Cl. ..... 568/6

(58) Field of Classification Search ..... None
See application file for complete search history.

(56) References Cited

U.S. PATENT DOCUMENTS

| | | | | |
|---|---|---|---|---|
| 3,480,548 | A | 11/1969 | Hellmuth et al. | |
| 3,679,584 | A | 7/1972 | Hellmuth | |
| 4,683,126 | A | 7/1987 | Inoue et al. | |
| 4,744,920 | A | 5/1988 | Fischer et al. | |
| 4,792,410 | A * | 12/1988 | Schwind et al. | 508/186 |
| 4,965,003 | A * | 10/1990 | Schlicht | 508/186 |
| 4,965,004 | A | 10/1990 | Schlicht et al. | |
| 5,098,587 | A * | 3/1992 | Hoornaert et al. | 508/186 |
| 6,551,967 | B2 * | 4/2003 | King et al. | 508/391 |
| 7,479,568 | B2 * | 1/2009 | Le Coent et al. | 558/286 |
| 2007/0123439 | A1 * | 5/2007 | Le Coent et al. | 508/373 |
| 2009/0099385 | A1 * | 4/2009 | Le Coent et al. | 558/297 |

FOREIGN PATENT DOCUMENTS

| | | |
|---|---|---|
| EP | 1 792 920 | 6/2007 |

OTHER PUBLICATIONS

International Search Report issued in counterpart Singapore Patent Application No. 200803547-9.
International Search Report issued in counterpart European Patent Application No. 08251078.5.

* cited by examiner

*Primary Examiner*—Daniel M Sullivan
*Assistant Examiner*—Chukwuma O Nwaonicha
(74) *Attorney, Agent, or Firm*—Claude J. Carui; M. Carmen & Associates, PLLC

(57) ABSTRACT

Provided is a new and improved process for preparing a borated alkaline earth metal toluene sulfonate salt.

26 Claims, No Drawings

PROCESS FOR MAKING BORATED ALKALINE EARTH METAL TOLUENE SULFONATES

The present invention pertains to an improved process for making borated alkaline earth metal toluene sulfonates.

The capacity of a lubricating oil composition to prevent and/or reduce wear is highly desirable and sought after. Boron-containing additives, and in particular, borated alkaline earth metal toluene sulfonates have been found to not only impart excellent anti-wear properties when employed in lubricating oil compositions, but also provide detergency, as well as anti-rust, anti-corrosion, and extreme pressure advantages to such compositions.

Certain methods of making borated sulfonates are known in the art. For example, in U.S. Pat. No. 4,683,126, Inoue et al. disclosed a two-step method for producing an alkaline earth metal borate dispersion. During the first step, materials (A) to (E) are mixed and undergo a reaction at 20° C. to 100° C., where (A) is 100 parts by weight of an oil-soluble neutral sulfonate of an alkaline earth metal; (B) is 10 to 100 parts by weight of a hydroxide or an oxide of an alkaline earth metal; (C) is boric acid in an amount that is 0.5 to 6.5 times of that of (B); (D) is 5 to 50 parts by weight of water; and (E) is 50 to 200 parts by weight of a dilution solvent. During the second step, the reaction mixture of the first step was heated to 100° to 200° C. in order to remove the water and much of the dilution solvent.

In two related patents, Hellmuth et al. disclosed a method of preparing a borated additive and a method of overbasing and increasing the total base number (TBN) of such a borated additive. Specifically, they described in U.S. Pat. No. 3,480,548, a borated additive prepared by reacting a lubricating oil dispersion of an alkaline earth metal carbonate and an alkaline earth metal hydrocarbon sulfonate with a boron compound selected from the group consisting of boric acids, boron oxides, and aqueous alkyl esters of boric acids. Moreover, in U.S. Pat. No. 3,679,584, they described a process for increasing the proportion of alkaline earth metal in an overbased alkaline earth metal sulfonate lubricating oil composition. That process comprised: (1) mixing a carbonate-overbased alkaline earth metal sulfonate, an alkaline earth metal hydroxide, and boric acid; and (2) contacting the resultant mixture with carbon dioxide.

In yet another example, Fischer et al. disclosed in U.S. Pat. No. 4,744,920, a carbonate-overbased product that was also borated. Specifically, that process comprised: (a) mixing an overbased sulfonate with one or more inert liquid media; (b) berating the mixture of (a) with a berating agent at a temperature that was sufficiently low to prevent substantial foaming; (c) raising the temperature of the mixture of (b) to a temperature that was higher than the boiling point of water; (d) remove substantially all of the water that was added to or generated from the reaction from the rest of the reaction mixture of (c), while retaining substantially all of the carbonate; and (e) harvesting the product of (d).

In a further example, Schlicht disclosed in U.S. Pat. No. 4,965,003, a process for preparing a borated and overbased oil-soluble metal detergent additive for lubricants. Specifically, that process comprised: (a) mixing a metal salt dissolved in a hydrocarbon solvent with a metal base and a polar solvent; (b) treating the metal salt mixture of (a) at a temperature ranging from about 10° C. to about 100° C. while passing an acidic gas through the mixture; (c) filtering the treated mixture of (b) at a temperature of about 10° C. to about 100° C.; (d) adding a borating agent to the filtrate of (c) and reacting the filtrate with the borating agent for a period of about 0.25 to about 5.0 hours at a temperature ranging from about 15° C. to about 100° C.; (e) heating the borated mixture of (d) at a temperature sufficiently high to distill all the water and a major portion of the polar solvent; (f) cooling the distilled and borated mixture of (e) to below the boiling point of the remaining solvent and filtering the cooled filtrate mixture: and (g) stripping the cooled and distilled filtrate mixture of (f) under a pressure ranging from about 10 to about 200 mms Hg, and at a temperature ranging from about 20° C. to about 150° C., thereby recovering the borated metal detergent additive.

A variation of this process was disclosed by Schlicht et al, in U.S. Pat. No. 4,965,004. That process comprised; (a) adding a borating agent to an overbased metal salt in the presence of a protic solvent and a hydrocarbon solvent and reacting for a period of about 0.25 to about 5.0 hours at a temperature ranging from about 15° C. to about 100° C.; (b) heating the borated metal salt mixture of (a) at a temperature sufficiently high to distill at least about 80 percent of the protic solvent feed; (c) cooling the distilled borated mixture of (b) to below the boiling point of the remaining solvent and filtering the cooled filtrate mixture; and (d) stripping the cooled distilled filtrate mixture of (c) under a pressure ranging from about 10 to about 200 mms Hg and at a temperature ranging from about 20° C. to about 150° C., and recovering the borated metal detergent additive.

Because of the prominent role of borated sulfonates as additives in the lubricant art, there remains great interest and need to develop improved processes to manufacture these salts, so that the resultant product may have various desirable properties. These desirable properties may include, for example, low sediment rates, good pour points, and capacities to protect against wear and corrosion.

Accordingly, in its broadest embodiment, the present invention pertains to a new and improved process for preparing a borated alkaline earth metal alkyltoluene sulfonate comprising:

(a) reading (i) at least one oil soluble alkyltoluene sulfonic acid, or an oil-soluble alkaline earth alkyltoluene sulfonate salt, or a mixture thereof;

(ii) at least one source of an alkaline earth metal;

(iii) at least one source of boron, in the presence of a mixture comprising;

a. at least one hydrocarbon solvent; and b. at least one low molecular weight alcohol; and (iv) one or more overbasing acids, at least one of which is boric acid;

(b) heating the reaction product from step (a) to a temperature that is greater than the distillation temperatures of the hydrocarbon solvent, the low molecular weight alcohol, and any water generated during step (a), so that the solvent, alcohol and water generated may be distilled from the reaction product of (a);

wherein no external source of water is added to the reaction mixture during the process.

The borated alkaline earth metal alkyltoluene sulfonate detergent of the first aspect may be further overbased in an additional overbasing step, using at least one overbasing acid that is other than a boric acid.

In a second aspect, the present invention pertains to a borated alkaline earth metal alkyltoluene sulfonate detergent additive prepared using the process of the first aspect.

Persons skilled in the art will understand other and further objects, advantages, and features of the present invention by referring to the following description.

DETAILED DESCRIPTION OF THE INVENTION

Various features and embodiments are described below by way of non-limiting illustrations.

The present invention provides a new and improved process of preparing borated alkyltoluene sulfonate detergents as described above. The borated alkyltoluene sulfonates prepared in accordance with this process may serve as detergents when included in a variety of industrial lubricating oils. These detergents lend to have low sediment rates, good flow properties at low temperatures, and favorable seal compatibilities. For example, the borated alkaline earth metal alkyltoluene sulfonate salts prepared in accordance with the process of the present invention demonstrates low sediment rates, such as less than about 0.15 vol. %, or less than about 0.12 vol. %, or less than about 0.10 vol. %, or even less than about 0.05 wt. %, such as less than about 0.03 vol. %, based on the total volumes of the resulting salts. When added to lubricating oil compositions, they have also been found to confer improved protection against wear and/or corrosion.

Specifically, the process for preparing a borated alkaline earth metal alkyltoluene sulfonate comprises:

(a) reacting (i) at least one oil soluble alkyltoluene sulfonic acid, or an oil soluble alkaline earth alkyltoluene sulfonate salt, or a mixture thereof;

(ii) at least one source of an alkaline earth metal;

(iii) at least one source of boron, in the presence of a mixture comprising:

a. at least one hydrocarbon solvent: and b. at least one low molecular weight alcohol;

and (iv) one or more overbasing acids, at least one of which is boric acid;

(c) heating the reaction product from step (a) to a temperature that is greater than the distillation temperatures of the hydrocarbon solvent, the low molecular weight alcohol, and any water generated during step (a), so that the solvent, alcohol and water generated may be distilled from the product of step (a);

wherein no external source of water is added to the reaction mixture during the process.

At Least One Hydrocarbon Solvent

Various known hydrocarbon solvents may be used in the process of the present invention. For example, a suitable hydrocarbon solvent may be n-pentane, n-hexane, cyclohexane, n-heptane, n-octane, isooctane, n-decane, or mixtures thereof. A suitable hydrocarbon solvent may also be an aromatic solvent, such as one selected from: xylene, benzene, toluene; and mixtures thereof. In an exemplary embodiment of the present invention, the hydrocarbon solvent is xylene.

At Least One Low Molecular Weight Alcohol

A suitable alcohol for the present process is typically one of relatively low molecular weight, having, for example, about 1 to about 13 carbon atoms and/or a molecular weight of no greater than about 200. Alcohols of those molecular weights tend to have boiling points that are sufficiently low so that they may be distilled from the reaction mixture after the reactions are complete. For example, a suitable alcohol may be one selected from a variety of low-molecular-weight monohydric alcohols, each comprising about 1 to about 13 carbon atoms. More specifically, such an alcohol may be, for example, methanol, ethanol, propanol, isooctanol, cyclohexanol, cyclopentanol, isobutyl alcohol, benzyl alcohol, beta-phenyl-ethyl alcohol, 2-ethylhexanol, dodecanol, tridecanol, 2-methylcyclohexanol, sec-pentyl alcohol, and tert-butyl alcohol. In an exemplary embodiment of the present invention, the low molecular weight monohydric alcohol is methanol.

A suitable low molecular weight alcohol may also be a polyhydric alcohol. For example, such an alcohol may be a dihydric alcohol, such as ethylene glycol.

Moreover, in some embodiments of the present invention, derivatives of certain suitable low molecular weight monohydric or polyhydric alcohols may also be used. Examples of these derivatives may include glycol monoethers and monoesters, such as monomethyl ether of ethylene glycol and monobutyl ether of ethylene glycol.

Art Oil-Soluble Alkyltoluene Sulfonic Acid

The borated alkyltoluene sulfonate additive of the present invention may be derived from an oil soluble alkyltoluene sulfonic acid. Methods of preparing sulfonic acids are known in the art. Specifically, the alkyltoluene sulfonic acid of the present invention may be prepared by sulfonating an alkyltoluene precursor using various known sulfonating agents, such as, for example, sulfuric acid, sulfur trioxide, chlorosulfonic acid, or sulfamic acid. Other conventional methods, such as the $SO_3$/Air Thin Film Sulfonation method may also be applied, wherein the alkyltoluene precursor is mixed with a $SO_3$/Air falling film made by CHEMITHON® or BALLESTRA®.

In turn, the alkyltoluene precursor may be originally derived from a conventional Friedel-Crafts reaction that alkylates toluene with an olefin. An alkyltoluene precursor of the present invention may comprise an alkyl chain that is about 10 to about 40 carbon atoms long. Another alkyltoluene precursor of the present invention may comprise an alkyl chain that is about 14 to about 30 carbon atoms long. Yet another alkyltoluene precursor of the present invention may comprise an alkyl chain that is about 18 to about 26 carbon atoms long. The toluene ring may be linked to any position on the alkyl chain except for position 1 on the alkyl chain. As persons skilled in the art will appreciate, "position 1" on an alkyl chain refers to the carbon position at the end of the chain. On the other hand, the alkyl chain can be linked to the toluene ring at any carbon position, except for the position at which the methyl group of the toluene is attached.

The olefin that is used to alkylate the toluene can be a single olefin or a mixture of various olefins, although the latter is typically the alkylation agent of choice. Regardless whether a single olefin or a mixture is used to alkylate the toluene, however the olefins are often isomerized. They may be isomerized prior to, during, or after the alkylation step, but are preferably isomerized prior to the alkylation step.

Methods of isomerizing olefin are known. Persons skilled in the art typically use one of at least two types of acidic catalysts for this purpose. Specifically, the acidic catalysts can be solid or liquid. A number of known solid acidic catalysts may be suitable, but a solid catalyst having at least one metal oxide is preferred. The metal oxide can be one selected from: natural zeolites, synthetic zeolites, synthetic molecular sieves, and clays. For example, the solid acidic catalyst comprises the acid forms of an acidic clay, or an acidic molecular sieve, or a zeolite having an average pore size of at least 6.0 angstroms. Useful acidic clays, including, for example, montmorillonite, laponite and saponite, may be derived from naturally-occurring or synthetic materials. Pillared clays may also serve as alkylation catalysts. Other molecular sieves with one-dimensional pore systems, having average pore sizes of less than 5.5 angstroms, may also serve as acidic catalysts. Examples include SM-3, MAPO-11, SAPO-11, SSZ-32, ZSM-23, MAPO-39, SAPO-39, ZSM-22, SSZ-20, ZSM-35, SUZ-4, NU-23, NU-86, and natural or synthetic ferrierites. These catalysts are described, for example, in HANDBOOK of MOLECULAR SIEVES by Rosamarie Szostak (New York, Van Norsrand Reinhold, 1992), and in U.S. Pat. No. 5,282,858, which are hereby incorporated by reference.

The isomerization process can be carried out, for example, at temperatures ranging from about 50° C. to about 280° C. Because olefins tend to have high boiling points, the process is suitably carried out in the liquid phase, in batch or continuous mode. In the batch mode, a stirred autoclave or glass flask, which may be heated to the desired reaction temperature, is typically used. On the other hand, a continuous process is most efficiently carried out in a fixed-bed process. In a fixed-bed process, space rates, which measure the rates of contact between the reactants and the catalyst beds, can range from about 0.1 WHSV to about 10 or more WHSV (i.e., weight of reactant feed per weight of catalyst per hour). The catalyst is charged into the reactor, which can be heated to the desired reaction temperature. The olefin can also be heated before it is exposed to the catalyst bed.

Persons skilled in the art are able to choose isomerization conditions under which particular levels of isomerization may be achieved. Specifically, the level of isomerization is typically characterized by the amount of alpha olefins and the level of branching in a particular olefin sample or mixture. The amount of alpha olefin and the level of branching can in turn be determined using various conventional methods, including, for example, Fourier Transformed Intra Red (FTIR) spectroscopy. In a typical FTIR spectroscopy method, the level (or percentage) of alpha olefins can be measured by following the absorbance of a particular sample at 910 $cm^{-1}$ and comparing it to the 910-$cm^{-1}$ absorbance of calibration samples with known alpha olefin levels. The level (or percentage) of alpha olefin in the calibration samples can be obtained, for example, from $^{13}C$ quantitative nuclear magnetic resonance (NMR) spectroscopy according to known protocols.

The percentage of branching can also be measured by FTIR spectroscopy by following the absorbance of a sample at 1378 $cm^{-1}$. This absorbance corresponds to the extent of deformation vibration of methyl groups. The absorbance of an isomerized olefin sample is then compared to the 1378-$cm^{-1}$ absorbance of a set of calibration samples with known branching levels. Typically, a particular olefin mix to be tested is first hydrogenated, converting the unbranched portion to n-alkanes and the branched portion to branched alkanes. Gas chromatography is then used to distinguish the unbranched n-alkanes from the branched alkanes, the proportion of which correlates to the percent branching level in that olefin mix.

While the olefins in the alkylation mixture may be branched or linear, an exemplary process of the present invention involves an alkyltoluene that is derived from a mixture of primarily linear alpha olefins.

Tire alkylation step of the present invention may take place prior to, simultaneously with, or after, the isomerization step. It is however preferred that the isomerization step occurs before the alkylation step, so that the olefins that are used to alkylate toluene comprise isomerized olefins.

Various known alkylation methods can be used to make the alkyl toluene precursors. For example, a typical alkylation reaction, which takes place in the presence of a hydrogen fluoride catalyst, may competently serve this purpose. Regardless of the method used to achieve alkylation, however, a one-stage reactor is nearly always used as the preferred vessel in which the reaction would take place.

The alkylation process typically takes place at a temperature ranging from about 20° C. to about 250° C. Similar to the isomerization process discussed above, the alkylation process is preferably carried out in a liquid phase to accommodate the liquid olefins at these temperatures. The alkylation process may be activated in batch or continuous mode, with the former mode being carried out in a heated and stirred autoclave or glass flask, and with the latter mode carried out in a fixed-bed process. In either mode, the reactor effluent typically contains alkyltoluene, mixed with excess toluene. The excess toluene can be removed by distillation, stripping evaporation under vacuum, or other means known to those skilled in the art.

An Alkaline Earth Metal Alkyltoluene Sulfonate Salt

A second and alternative starting material may be an alkaline earth metal alkyltoluene sulfonate salt, which can also be prepared by methods known to those skilled in the art. Specifically, it may be obtained by reacting an alkyltoluene sulfonic acid with a source of suitable alkaline earth metal. An exemplary method comprises combining a reactive base of such a metal, such as a hydroxide, with an alkyltoluene sulfonic acid in the presence of a hydroxilic promoter. Conventionally this hydroxilic promoter may be water, but according to the present invention, no external water source of water is added to the reaction mixture. Accordingly, the only water that may or may not be present in the reaction mixture is the byproduct of the reaction. Instead of water, a suitable alcohol such as 2-ethyl hexanol, methanol, or ethylene glycol may serve as the hydroxilic promoter. In an exemplary process of the present invention, the hydroxilic promoter is methanol.

Moreover, this reaction takes place in inert solvent, in which the resulting sulfonate salt may be dissolved. As stated above, that inert solvent may be selected from: n-pentane, n-hexane, cyclohexane, n-heptane, n-octane, isooctane, n-decane, benzene, toluene, xylene, or mixtures thereof. In an exemplary process of the present invention, that inert solvent is xylene.

Suitably, an alkaline earth metal of the present invention may be calcium, barium, magnesium or strontium. In an exemplary embodiment of the present invention, the alkaline earth metal toluene sulfonate is a calcium salt, and the reactive base of that salt is calcium hydroxide (also known as lime). In another exemplary embodiment, the reactive base is calcium oxide.

The weight ratio of low molecular weight alcohol to the source of an alkaline earth metal in the process of the present invention is typically greater than about 0.20:1, or greater than about 0.30:1, or even greater than about 0.35:1. In exemplary process of the present invention, the ratio of the amount of low molecular weight alcohol to the amount of an alkaline earth metal reactive base is about 0.40:1. In another exemplary process of the present invention, the ratio of the amount of low molecular weight alcohol to the amount of an alkaline earth metal reactive base is about 0.33:1.

A Source of Boron

The alkaline earth metal toluene sulfonate salt of the present invention, whether derived originally from an oil-soluble toluene sulfonic acid starting material or is itself the starting material, is further borated. Specifically, a source of boron is introduced into the reaction mixture to achieve this end. That source may be in the form of, for example, boric acid, boron anhydride, boron esters, or similar boron-containing materials. The boron source of an exemplary process of the present invention is orthoboric acid (also known as boric acid). Although no external source of water is added to the reaction mixture, water is nonetheless the byproduct of the reaction involving an alkaline earth metal reactive base with either or both a alkyltoluene sulfonic acid or an alkaline earth alkyltoluene sulfonate salt, in the presence of a suitable low molecular weight alcohol. It is believed that condensation of boric acid may occur in the presence of water to form boric acid oligomers, such as, for example, those represented by the formulae below:

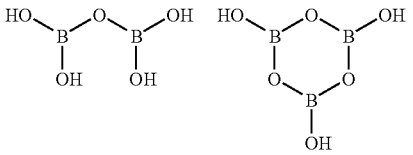

These oligomers then react with the alkaline earth metal reactive bases to form borated salts, thereby introducing boron into die alkaline earth metal alkyltoluene sulfonates.

One or More Overbasing Acids

The borated alkaline earth metal alkyltoluene sulfonate salts of the present invention are typically overbased. By definition, overbased materials are characterized by a metal content in excess of that which would be present according to the stoichiometry of the metal cation in the sulfonate said to be overbased. The term "base number" or "BN" refers to the amount of base equivalent to milligrams of KOH in one gram of sample. Thus, higher BN reflects more alkaline products and thus a greater alkalinity reserve. The BN of samples can be determined by a variety of methods, including, for example, ASTM test No. D2896 and other equivalent procedures. The term "total base number" or "TBN" refers to the amount of base equivalent to milligrams of KOH in one gram of functional fluid. These terms are often used interchangeably with "base number" or "BN," respectively. The term "low overbased" refers to a BN or TBN of about 2 to about 60. The term "high overbased" refers to a BN or TBN of about 60 or more.

The alkaline earth metal alkyltoluene sulfonate sails of the present invention may have a TBN of about 10 to about 500, or about 50 to about 400, or even about 100 to about 300, such as about 150 to about 200. An exemplary alkaline earth metal alkyltoluene sulfonate salt of the present invention is highly overbased and has a TBN of about 160.

Many conventional methods and reaction conditions for overbasing involve overbasing by carbon dioxide. Examples of such methods and conditions are described in U.S. Pat. No. 3,496,105, and others. The borated alkaline earth metal alkyltoluene sulfonates of the present invention are overbased, each with one or more overbasing acids, at least one of which is boric acid. Accordingly, if boric acid is included in the process as the source of boron, it may also serve to overbase the resulting borated salt. An exemplary process applies a single overbasing acid, which is boric acid.

The Process

In an exemplary process of the present invention, a hydrocarbon solvent such as xylene is premixed with a low molecular weight alcohol such as methanol and a source of an alkaline earth metal such as a calcium hydroxide. This premixing step is performed at or near ambient temperature, such as at about 15° C. to about 40° C., or at about 20° C. to about 35° C.

Following premixing and if necessary, foam inhibitors and other processing aids may optionally be added to the reaction vessel.

An alkyltoluene sulfonic acid may then be added to the mixture with, agitation. Typically, the alkyltoluene sulfonic acid is added slowly over a period of time to avoid a rapid rise in temperature in the reaction mixture, maintaining the temperature of that mixture in a range of about 20° C. to about 55° C. Thereafter, the reaction mixture is agitated for about 5 minutes to about 20 minutes at a temperature of about 40° C. to about 50° C., or about 41° C. to about 46° C., so as to insure adequate neutralization of the alkaline earth metal reactive base. The reaction mixture is then cooled using a bath or other cooling mechanism to about 20° C. to about 25° C., or about 21° C. to about 24° C., and is held at this temperature range for about 1 hour to about 3 hours. This neutralization step may be omitted if an alkaline earth metal toluene sulfonate salt is the starting material instead of a toluene sulfonic acid.

A source of boron such as boric acid is then added slowly over a period of about 20 minutes to about 40 minutes to the neutralized reaction mixture, white maintaining the temperature of that mixture at about 20° C. to about 30° C. This is followed by holding the reaction mixture at about 25° C. to about 50° C. for an additional 15 minutes. Again, this mixture is cooled to about 20° C. to about 25° C. The cooling mechanism is then removed from the reaction vessel either immediately or within about 30 minutes.

Typically, the reaction mixture is then slowly heated to reach one or more various intermediate temperatures. It is believed that this stepped heating approach may serve to reduce the amount of sediments in the final product. In an exemplary process of the present invention, the reaction mixture is heated to a first intermediate temperature of about 65° C. in about 20 minutes to about 40 minutes, followed by heating to a second intermediate temperature of about 80° C. in about 90 minutes to about 2 hours, followed by heating to a third intermediate temperature of about 90° C. to about 95° C. in about 1 hour.

The low molecular weight alcohol, the hydrocarbon solvent, as well as the water that has been generated during the reaction so far are then removed from the reaction mixture through separation methods that are known in the art. An exemplary process of the present invention employs the well-known method of distillation, simply heating the reaction mixture to above the boiling temperatures of the alcohol, solvent and water. In that process, the reaction mixture is heated to about 125° C. to about 140° C. in about 1 hour.

Optionally, an inert liquid medium, such as a diluent oil or a lubricant base oil, may then be added to the reaction mixture to reduce the viscosity of the reaction mixture and/or disperse the product. Suitable diluent oils are known in the art, and are defined, for example, in Fuels and Lubricants Handbook, (George E, Totten, ed., (2003)) at page 199, as "base fluids . . . of mineral origin, synthetic chemical origin or biological origin." It may not be necessary to add such an inert liquid medium at this juncture if, for example, the product is extruded.

The distillation step typically continues for about 2 hours at a temperature of about 180° C. to about 200° C., followed by holding the reaction mixture for about 15 minutes at that temperature. The unreacted alkaline earth metal reactive base, source of boron (if other than boric acid), and boric acid are then eliminated using conventional and well known methods such as centrifugation and/or filtration. In an exemplary process of the present invention, filtration takes place in the presence of a certain filter aid in a precoated pressure filter and the resulting product is washed with precoat oil and stored.

The resulting borated alkaline earth metal alkyltoluene sulfonate salt of the present invention comprise about 2 to about 6 wt. %, or about 3 to about 5 wt. %, or even about 3.2 to about 4.5 wt. %, such as about 3.5 to about 4.3 wt. %, of boron. The level of boron in the salt can be measured by certain standard methods that are well known in the art, such as, for example, the ASTM D4951, or ASTM D5185. Moreover, the resulting borated alkaline earth metal alkyltoluene sulfonate of the present invention typically has a boron to alkaline earth metal ion ratio of in the range of about 1:0.2 to about 1:0.7, or about 1:0.3 to about 1:0.6, or even about 1:0.5 to about 1:0.58, such as about 1:0.51 to about 1:0.56.

A borated alkaline earth metal alkyltoluene sulfonate salt prepared by the process of the present invention typically has a low sediment rate. Typically the volume of sediment is less than about 0.15 vol. %, or less than about 0.12 vol. %, or less than about 0.10 vol. %, or even less than about 0.05 wt. %, such as less than about 0.03 vol. %, based on the total volume the resulting salt. The sediment rate can be measured by certain standard methods that are well known in the art, such as the ASTM D2273.

Moreover, a borated alkaline earth metal alkyltoluene sulfonate salt prepared by the process of the present invention has a viscosity at 100° C. of about 150 cSt to about 280 cSt, or about 170 cSt to about 250 cSt, such as about 200 cSt, as measured in accordance with the ASTM D445. That salt may also have a flash point of greater than about 170° C., or even about 180° C., such as about 190° C., as measured in accordance with the ASTM D93.

This invention will be further understood by reference to the following examples, which are not to be considered as limitative of its scope.

EXAMPLES

The following examples are provided to illustrate the present invention without limiting it. While the present invention has been described with reference to specific embodiments, this application is intended to encompass those various changes and substitutions that may be made by those skilled in the art without departing from the spirit and scope of the appended claims.

Example 1

Preparing an Overbased Borated Calcium Alkyltoluene Sulfonate

In a 5-liter glass vessel, about 228 grams of methanol, about 1800 grams of xylene, and about 192.5 grams of hydrated lime (calcium hydroxide) were mixed to achieve homogeneity or near homogeneity. About 572 grams of an alkyltoluene sulfonic acid, which had a molecular weight of about 471, was added to the vessel, while maintaining the temperature in the reaction mixture in the range of about 20° C. to about 30° C. This addition was completed in about 15 minutes. About 291.9 grams of boric acid powder was then added to the vessel, while maintaining the temperature of the reaction mixture in the range of about 30° C. to about 35° C. The reaction mixture was then kept at this temperature for about 15 minutes. The vessel containing the reaction mixture was then heated in 3 steps: (1) from about 35° C. to about 65° C.; (2) from about 65° C. to about 93° C.; and from about 93° C. to about 128° C. About 358 grams of a Group I mineral oil was added to the vessel and the mixture was stirred. The entire mixture was then subject to centrifugation at a 10,000 G and the solid sediment was removed. This was followed by heating the liquid phase to about 185° C. under a vacuum of about 40 mbar, thereby distilling the solvent xylene.

This process was repeated in a second batch using the set of steps and the same amount of all materials except that the amount of methanol added to the premixture was increased to about 240 grams. The resulting salts were analyzed and its various properties are listed in Table 1 below.

TABLE 1

Analysis of the Borated Calcium AlkylToluene Sulfonate Salts

| Properties | Batch 1 | Batch 2 |
|---|---|---|
| wt. % Calcium | 7.66 | 7.90 |
| wt. % Sulfur | 2.81 | 2.80 |
| wt. % Boron | 4.09 | 4.08 |
| Base Number (mgKOH/g) | 168 | 174 |
| Closed Cup PMCC Flash Point (° C.) | 202 | 196 |

Example 2

Larger Scale Preparation of An Overbased Borated Calcium Toluene Sulfonate

A 1900-liter stainless steel reactor equipped with a turbine mixer, a hot-oil jacket and a cooling coil was used as the reaction vessel. About 798 kilograms of mixed xylene was charged into the vessel. The reactor was then cooled to about 20° C., which was below the flash point of xylene. A nitrogen purge step was used to reduce the amount of oxygen in the reactor to about 3 ppm. About 126 kilograms of calcium hydroxide powder was then added to the reactor via a screw conveyer. The contents in the reactor was blended and mixed, while about 351 kilograms of alkyltoluene sulfonic acid was added to the reactor over a period of about 48 minutes, during which the temperature of the reaction mixture rose to about 43° C. The reactor was cooled to about 20° C., and about 195 kilograms of boric acid was added through the screw conveyor over a period of about 10 minutes. About 113 kilograms of methanol was then added to the reactor over a period of about 15 minutes, during which the temperature of the reaction mixture rose to about 36° C. The contents of the reactor was blended and mixed at that temperature for about another 15 minutes. The reactor was then heated in 4 steps at atmospheric pressure to remove the methanol and the water that was generated during the reaction: (1) from about 34° C. to about 69° C., over a period of about 60 minutes; (2) from about 69° C. to about 78° C., over a period of about 100 minutes; (3) from about 78° C. to about 93° C., over a period of about 60 minutes; and (4) from about 93° C. to about 127° C. over a period of about 60 minutes. About 163 kilograms of a 100 Neutral Oil was added to the reactor. The reactor was then heated to about 171° C. and the pressure in the reactor was reduced to about 50 mms Hg over a period of about 115 minutes so that the xylene may be distilled. The pressure in the reactor was then restored to the atmospheric pressure. Thereafter, about 23 kilograms of 100 Neutral Oil was added to the reactor. A pressure filter with the aid of diatomateous earth was used to filter away the sediments, which was estimated to be about 1.2 vol. %.

The resulting borated toluene sulfonate salt was analyzed and its properties are listed below in Table 2.

TABLE 2

| Larger Scale Preparation of an Overbased Borated Calcium Alkyltoluene Sulfonate | |
|---|---|
| Properties | Large Scale Batch |
| wt. % Calcium | 7.65 |
| wt. % Sulfur | 2.78 |
| wt. % Boron | 4.03 |
| Base Number (mgKOH/g) | 167 |
| Kinematic Viscosity @ 100° C. (cSt) | 112 |

What is claimed is:

1. A process for preparing an overbased borated alkaline earth metal alkyltoluene sulfonate comprising:

(a) reacting (i) at least one oil soluble alkyltoluene sulfonic acid, or an oil soluble alkaline earth alkyltoluene sulfonate salt, or a mixture thereof;

(ii) at least one source of an alkaline earth metal; and (iii) one or more overbasing acids, at least one of which is a boric acid, in the presence of a mixture comprising: (1) at least one hydrocarbon solvent; and (2) at least one low molecular weight alcohol;

(b) heating the reaction product from step (a) to a temperature that is greater than the distillation temperatures of the hydrocarbon solvent, the low molecular weight alcohol, and any water generated in step (a), so that the solvent, alcohol and water generated may be distilled from the product from step (a); wherein no external source of water is added during the process; and further comprising (c) an overbasing step wherein the overbased borated alkaline earth metal alkyltoluene sulfonate prepared from steps (a) and (b) is further overbased with one or more overbasing acids.

2. The process according to claim 1, wherein the low molecular weight alcohol is a monohydric alcohol.

3. The process according to claim 2, wherein the monohydric alcohol is methanol.

4. The process according to claim 1, wherein the hydrocarbon solvent is xylene.

5. The process according to claim 1, wherein the source of an alkaline earth metal is an alkaline earth metal hydroxide or an alkaline earth metal oxide.

6. The process according to claim 5, wherein the source of alkaline earth metal is calcium hydroxide.

7. The process according to claim 1, further comprising a source of boron other than boric acid.

8. The process according to claim 1, wherein the weight ratio of low molecular weight alcohol to source of alkaline earth metal is greater than about 0.2:1.

9. The process according to claim 8, wherein the weight ratio is greater than about 0.3:1.

10. The process according to claim 9, wherein the weight ratio is greater than about 0.4:1.

11. The process according to claim 1, wherein the alkyl group of the oil soluble alkyltoluene sulfonic acid is a linear alkyl group.

12. The process according to claim 11, wherein the linear alkyl group of the alkyltoluene sulfonic acid is about 10 to about 40 carbon atoms in length.

13. The process according to claim 12, wherein the linear alkyl group of the alkyltoluene sulfonic acid is about 12 to about 30 carbon atoms in length.

14. The process according to claim 13, wherein the linear alkyl chain of the alkyltoluene sulfonic acid is about 18 to about 26 carbon atoms in length.

15. The process according to claim 1, wherein the overbased borated alkaline earth metal toluene sulfonate has a TBN of about 10 to about 500.

16. The process according to claim 15, wherein the overbased borated alkaline earth metal toluene sulfonate has a TBN of about 50 to about 400.

17. The process according to claim 16, wherein the overbased borated alkaline earth metal alkyltoluene sulfonate has a TBN of about 100 to about 300.

18. The process of claim 1, wherein the one or more overbasing acids in step (c) is carbon dioxide.

19. A process for preparing an overbased borated alkaline earth metal alkyltoluene sulfonate comprising:

(a) reacting (i) at least one oil soluble alkyltoluene sulfonic acid, or an oil soluble alkaline earth alkyltoluene sulfonate salt, or a mixture thereof, wherein the alkyl group is derived from an isomerized olefin;

(ii) at least one source of an alkaline earth metal; and (iii) one or more overbasing acids, at least one of which is a boric acid, in the presence of a mixture comprising: (1) at least one hydrocarbon solvent; and (2) at least one low molecular weight alcohol; and (b) heating the reaction product from step (a) to a temperature that is greater than the distillation temperatures of the hydrocarbon solvent, the low molecular weight alcohol, and any water generated in step (a), so that the solvent, alcohol and water generated may be distilled from the product from step (a); wherein no external source of water is added during the process.

20. The process of claim 19, wherein the alkyl group is about 10 to about 40 carbon atoms.

21. The process of claim 19, wherein the source of an alkaline earth metal is calcium hydroxide.

22. The process of claim 19, wherein the low molecular weight alcohol is methanol and the hydrocarbon solvent is xylene.

23. The process of claim 19, wherein the overbased borated alkaline earth metal toluene sulfonate has a TBN of about 10 to about 500.

24. The process of claim 19, wherein the overbased borated alkaline earth metal toluene sulfonate has a TBN of about 50 to about 400.

25. The process of claim 19, further comprising a source of boron other than boric acid.

26. An overbased borated alkaline earth metal alkyltoluene sulfonate prepared by the process of claim 19, wherein the alkyl group of said alkyltoluene sulfonate is derived from an isomerized olefin and further wherein said overbased borated alkaline earth metal alkyltoluene sulfonate has less than about 0.15 vol. % sediment.

* * * * *